United States Patent [19]

Chichester

[11] Patent Number: 4,781,002

[45] Date of Patent: Nov. 1, 1988

[54] DAMAGE RESISTANT REFLECTIVE TEXTURED SURFACE SYSTEM

[76] Inventor: S. Tebbs Chichester, 1716 Aberdeen Cir., Crofton, Md. 21114

[21] Appl. No.: 142,821

[22] Filed: Jan. 11, 1988

[51] Int. Cl.[4] ..... B44F 1/02

[52] U.S. Cl. ..... 52/311; 52/663; 52/812

[58] Field of Search ..... 52/311, 316, 786, 794, 52/812, 818, 663, 664; 350/600

[56] References Cited

U.S. PATENT DOCUMENTS

| | | | |
|---|---|---|---|
| 1,257,985 | 5/1918 | Duffy | 52/663 |
| 2,248,233 | 7/1941 | Heritage | 52/316 |
| 2,607,455 | 8/1952 | Yellin | 52/663 |
| 3,197,160 | 7/1965 | Murphy | 52/664 |
| 3,267,628 | 8/1960 | Seery | 52/311 |
| 3,396,497 | 8/1968 | Murphy | 52/311 |
| 3,661,613 | 5/1972 | Contreal et al. | 52/316 |
| 4,353,193 | 10/1982 | Sanderson | 52/311 |

*Primary Examiner*—David A. Scherbel
*Assistant Examiner*—Caroline D. Dennison
*Attorney, Agent, or Firm*—Foley & Lardner, Schwartz, Jeffery, Schwaab, Mack, Blumenthal & Evans

[57] ABSTRACT

A scar-resistant decorative wall panel has a mirror surface overlaid by a substantially coarse-mesh, common weave wire screen giving a peek-through changing-with-angle view of the mirror surface. Viewed at the perpendicular to it, the mirror surface gives a substantial-area reflection of the viewer that may be as much as 30 to 50% of the mirror surface. At angles from the perpendicular increasingly approaching 45 degrees, the view of the mirror surface progressively diminishes for two reasons: (1) the weave of the mesh blocks progressively more of the view of the mirror surface and (2) the reflection of the back surface of the mesh appears to occupy increasing areas of this mirror surface, decreasing in this way the view of this mirror surface. Both these phenomena act together in a tendency to hide and confuse to a casual viewer defacement of the mirror surface, and the substantially vandal-proof overlying coarse-mesh screen at the same time protects the mirror surface from broad-area-contact type scarring.

4 Claims, 2 Drawing Sheets

DAMAGE RESISTANT REFLECTIVE TEXTURED SURFACE SYSTEM

FIELF OF THE INVENTION

This invention relates generally to wall structures and particularly to ornamental wall panels particularly suited for use in areas such as elevators and passageways and characterized by damage resistance with an ornamental appearance.

BACKGROUND OF THE INVENTION

Decoratively surfaced, multi-level wallboard of criss-cross relief pattern is disclosed in U.S. Pat. No. 2,248,233 issued to C. C. Heritage on July 8, 1941. Similarly for decorative purposes, multi-level screens are disclosed in U.S. Pat. No. 3,267,628 issued to R. F. Seery on Aug. 23, 1960. Multi-level decorator panels with patterning of regular shape and of irregular shape are disclosed in U.S. Pat. No. 3,661,613 issued to R. G. Contrell et al on May 9, 1972. Multi-level panels with screening layers are disclosed in U.S. Pat. No. 4,353,193 issued to D. S. C. Sanderson on Oct. 12, 1982.

SUMMARY OF THE INVENTION

However, in spite of the various devices of the type that have been disclosed none is believed to provide the advantages of the present invention in accordance with the objects set forth, a primary object of which is to provide a textured reflective surface of woven wire cloth over sheet metal that provides a degree of decoration with protection that will become the standard of commerce for the purposes set forth.

Further objects are to provice a system as described that creates the appearance of one space-enhancing textured reflective surface and protects against and hides vandalism in that scratches and the like tend to be camouflaged by multiple obscuration/reflection characteristics and by optical confusion caused by back-reflection of a mirror-overlying grid that fractures the appearance of blemishes.

Said another way, a scar-resistant decorative wall panel has a mirror surface overlaid by a substantially coarse-mesh, common-weave wire screen giving a peek-through changing-with-angle view of the mirror surface. Viewed at the perpendicular to it, the mirror surface gives a substantial-area reflection of the viewer that may be as much as 30 to 50% of the mirror surface. At angles from the perpendicular increasingly approaching extinguishment at 15 to 20 degrees, the view of the mirror surface progressively diminishes for two reasons: (1) the weave of the mesh blocks progressively more of the view of the mirror surface and (2) the reflection of the back surface of the mesh appears to occupy increasing areas of this mirror surface, decreasing in this way the view of the mirror surface. Both these phenomena act together in a tendency to hide and confuse to a casual viewer defacement of the mirror surface, and the substantially vandalproof overlying coarse-mesh screen at the same time protects the mirror surface from broad-area-contact type scarring.

BRIEF DESCRIPTION OF THE DRAWINGS

The above and other objects and advantages of this invention will become more readily apparent on examination of the following description in which like reference characters refer to like parts.

DETAILED DESCRIPTION

Figure 1:
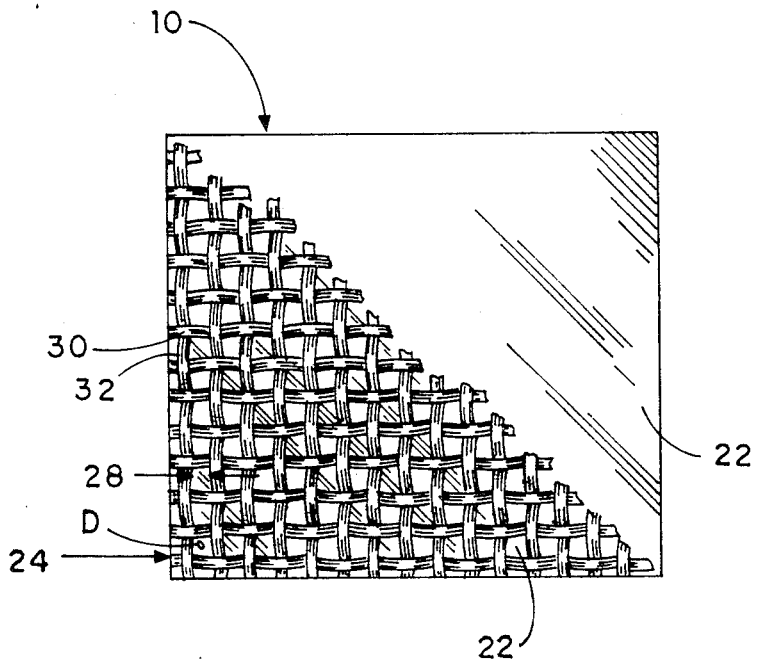
FIG. 1 is a fragmentary front elevational view of a preferred embodiment panel.
Figure 2:
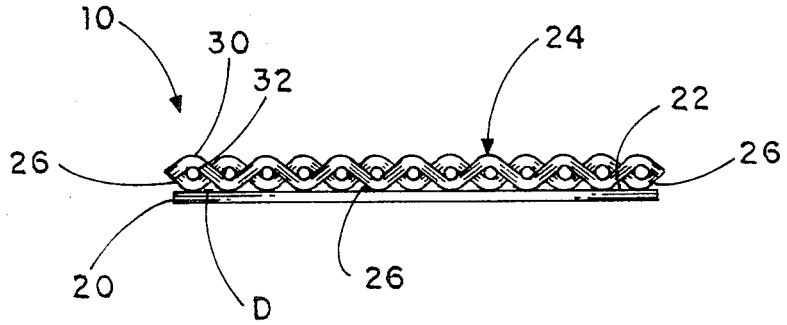
FIG. 2 is an edge view thereof.

In FIGS. 1 and 2, the system of the invention is generally indicated at 10 and comprises a back plate 20 with a reflective or mirror surface 22 throughout, and a simple or common woven mesh screen 24 affixed over the mirror surface as by bonding 26 at some or all points of contact.

Viewed perpendicularly, a maximum of each portion of the mirror surface 22 shows through the interstices 28 of the weave formed by the strands 30, 32. These are substantially small portions and the viewer is likely to see his or her image (a larger pattern) and to ignore scratched, punched or other defaced bits as at D. On the other hand, the viewer may observe defacements to some degree. However, in the usual case, viewing will be at an angle to the perpendicular, and this will provide further concealment of defacements.

Figure 3:
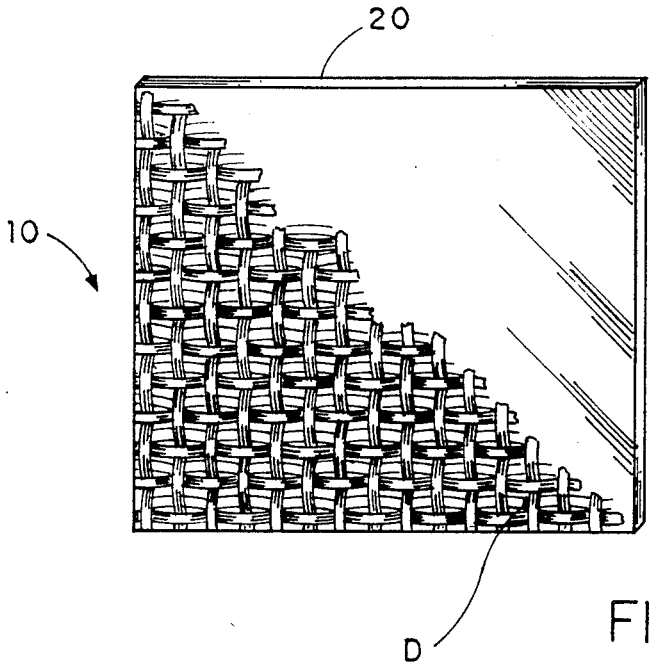
FIG. 3 is a view similar to that of FIG. 1 but viewed at an angle to the perpendicular.
Figure 4:
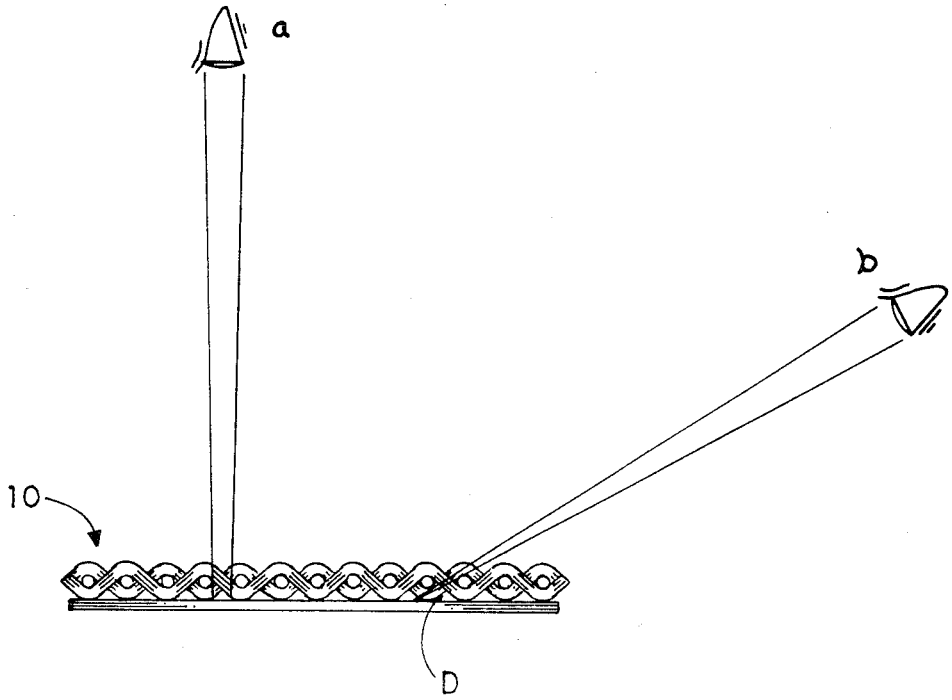
FIG. 4 is an edge view similar to that of FIG. 2, but diagramming lines of sight.

FIGS. 3 and 4 show this result. At "a" the viewer sees his or her eye. The greater the viewing angle to the perpendicular, the more obscuration of blemishes, as at "b" occurs. Two factors work together to provide this desirable result. First, the mirror gives increasingly with incline a view of the back of the strands of screen. This effect continues to increase up to chosen viewing angles of 40° to 80° from the perpendicular, concealing blemishes as at D, depending on strand size and mesh spacing factors.

Second, the foreshortening of the screen provided by the three-dimensional structure of this screen increases obscuration with angle, until obscuration is substantially complete, the interstices vanishing. Both these phenomena together work to suppress visibility of scars on the mirror.

Finally, the coarse screen characteristics are also selected for preventing most scarring contact that might result from broad-area contact, with the mirror surface 24.

Preferably the screen is of about 1/16 inch (1.5 mm) diameter wire woven over and under on ¼ inch (3 mm) centers, the interstices being farther across than the strand at the perpendicular, preferably.

Bronze, aluminum, stainless steel, or other suitable metal and/or plastic may be used for the screen and the mirror surface.

This invention is not to be construed as limited to the particular forms disclosed herein, since these are to be regarded as illustrative rather than restrictive. It is, therefore, to be understood that the invention may be practiced within the scope of the claims otherwise than as specifically described.

What is claimed and desired to be protected by United States Letters Patent is:

1. A damage resistant reflective surface system, comprising:

(a) a sheet having a surface which is in a plane and at least partially reflective, (b) a mesh screen adapted to be positioned over said reflective surface to protect said surface and camouflage any defacement thereof, said screen being comprised of a first series of spaced strands extending in one direction and a second series of spaced strands extending in a direction at an angle to said first direction, the spacing of said strands providing open areas through which projected and reflected light can pass to and from said reflective surface, said strands having a sufficient thickness to provide with said sheet a three dimensional structure whereby light reflecting from said reflective surface also reflects from said strands, and (c) means for securing said mesh screen to said reflective surface, whereby maximum reflection occurs when viewing said surface from a direction substantially perpendicular thereto, with the amount of reflection viewed decreasing as the viewer moves toward the plane of said reflective surface due to the projection of said mesh screen outwardly of said surface and the reflection from said strands, such movement tending to camouflage any defacements appearing on said reflective surface, with continued movement in such direction entirely obscuring said openings.

2. The system of claim 1 wherein said mesh screen is woven in an over and under weave, the under portions of the strands contacting said reflective surface and the over portions of the strands projecting forwardmost from said surface, the thickness of said strands being such that a substantial three dimensional structure is formed.

3. The system of claim 2 wherein the thickness of said strands is substantially less than the spacing between adjacent strands.

4. The system of claim 2 wherein said strands are formed of wire approximately 1.5 mm in diameter and adjacent strands of each series spaced from each other at least 3 mm, said first and second series of wire strands being perpendicular to each other so as to form a grid-like mesh having openings substantially larger than the thickness of individual wire strands.

* * * * *